US007562748B2

(12) United States Patent
Stranieri et al.

(10) Patent No.: US 7,562,748 B2
(45) Date of Patent: Jul. 21, 2009

(54) ELEVATOR CALL BUTTON WITH TACTILE FEEDBACK

(75) Inventors: Paul A. Stranieri, Bristol, CT (US); Dang V. Nguyen, South Windsor, CT (US)

(73) Assignee: Otis Elevator Company, Farmington, CT (US)

( * ) Notice: Subject to any disclaimer, the term of this patent is extended or adjusted under 35 U.S.C. 154(b) by 739 days.

(21) Appl. No.: 10/553,375

(22) PCT Filed: May 19, 2003

(86) PCT No.: PCT/US03/15950

§ 371 (c)(1), (2), (4) Date: Oct. 19, 2005

(87) PCT Pub. No.: WO2004/103879

PCT Pub. Date: Dec. 2, 2004

(65) Prior Publication Data

US 2007/0045050 A1 Mar. 1, 2007

(51) Int. Cl.
*B66B 1/14* (2006.01)
*B66B 1/46* (2006.01)
*B66B 3/00* (2006.01)

(52) U.S. Cl. ..... 187/395; 187/391

(58) Field of Classification Search ..... 187/391, 187/395; 340/999

See application file for complete search history.

(56) References Cited

U.S. PATENT DOCUMENTS 5,398,783 A * 3/1995 Jacoby ..... 187/395
5,497,149 A 3/1996 Fast
5,679,934 A * 10/1997 Juntunen et al. ..... 187/395
5,952,626 A * 9/1999 Zaharia ..... 187/381
5,990,432 A 11/1999 Kuroda
6,239,726 B1 5/2001 Saida
7,404,471 B2 * 7/2008 Felder et al. ..... 187/395
2004/0262093 A1 * 12/2004 Forsythe et al. ..... 187/391
2006/0065490 A1 * 3/2006 Zaharia et al. ..... 187/384
2007/0089939 A1 * 4/2007 Liebetrau ..... 187/395
2008/0264731 A1 * 10/2008 Mangini et al. ..... 187/382

FOREIGN PATENT DOCUMENTS

JP 01160248 A * 6/1989
JP 09077400 3/1997
JP 09142749 A * 6/1997

(Continued)

OTHER PUBLICATIONS

PCT International Search Report mailed Sep. 5, 2003, relating to International Application No. PCT/US03/15950.

*Primary Examiner*—Walter Benson
*Assistant Examiner*—Eduardo Colon-Santana
(74) *Attorney, Agent, or Firm*—Carlson, Gaskey & Olds PC

(57) ABSTRACT

An elevator call button assembly (20) includes at least one call button (50) having a surface (70) that is touchable by an individual to indicate a desired call in the elevator system. A responder (56) provides a tactile indication that the call has been successfully placed. In one example, the responder (56) comprises a vibrating motor that moves a moveable member (52) once the system controller (68) has successfully received a signal indicating the desired call.

21 Claims, 2 Drawing Sheets

FOREIGN PATENT DOCUMENTS

| | | | |
|---|---|---|---|
| JP | 09240939 A | * | 9/1997 |
| JP | 2000034068 | | 2/2000 |
| JP | 2000181602 | | 6/2000 |
| JP | 2000222968 | | 8/2000 |
| JP | 2002053274 A | * | 2/2002 |

* cited by examiner

ELEVATOR CALL BUTTON WITH TACTILE FEEDBACK

1. FIELD OF THE INVENTION

This invention generally relates to call buttons for elevator systems. More particularly, this invention relates to providing tactile feedback indicating a successful call.

2. DESCRIPTION OF THE RELATED ART

Elevator systems typically include a car that travels to various landings within a building for transporting passengers or cargo between levels of the building. At each landing there typically are call buttons that are accessible for an individual to send a signal indicating a desire to have the car stop at that landing. Additional call buttons are provided within the car in a car operation panel that allows an individual to select a particular floor level, for example, to which the elevator car should take them.

Call button activation sends a signal to the system controller, which responsively controls movement of the elevator car according to the received signal (i.e., bringing the car to a particular landing or taking the car to a particular floor level). Some calls buttons include a light feature that lights up when the button has been activated. This provides a visible acknowledgement to an individual that their call has been received by the controller and that they can expect the elevator system to service them as desired.

Some call button arrangements provide a sound upon call button activation. A "beep," "chime" or "ring" type of noise provides audible feedback to an individual that their call has been successfully placed.

While such arrangements have proven useful, there are situations where they are not adequate. The lighted arrangements do not provide any feedback to an individual who is blind or visually impaired, for example. The sound-emitting arrangements do not provide any feedback to a deaf or hearing impaired individual. Additionally, those skilled in the art are constantly striving to make improvements in the effectiveness of various aspects of elevator systems. There is a need for an improved arrangement that provides an indication to a wider variety of individuals that their call has been successfully placed and that they can expect the elevator system to service them as desired. This invention addresses that need.

SUMMARY OF THE INVENTION

In general terms, this invention is an elevator call button device that provides tactile feedback indicating that a desired call has been placed.

One example device designed according to this invention includes a surface that is manually touchable to indicate a desired call. A responder automatically provides a tactile confirmation of the desired call.

In one example the touchable surface is supported on a moveable button member that is manually moveable to indicate the desired call. In one example the responder comprises an automated mover that automatically moves the moveable member to provide the tactile confirmation.

In one example the tactile confirmation is provided by a vibrating motor supported as part of the call button arrangement.

A method of acknowledging that a call button signal has been received in an elevator system according to this invention includes providing a tactile confirmation at the call button upon successful receipt of the signal.

The various features and advantages of this invention will become apparent to those skilled in the art from the following detailed description of the currently preferred embodiments. The drawings that accompany the detailed description can be briefly described as follows.

DETAILED DESCRIPTION OF THE PREFERRED EMBODIMENTS

A call button arrangement designed according to this invention provides an individual with tactile feedback that a desired call signal has been successfully received by a system controller, for example. An automated mover associated with the call button structure provides a tactile indication to the individual, which communicates to the individual that the desired call has been successfully placed.

Figure 1:
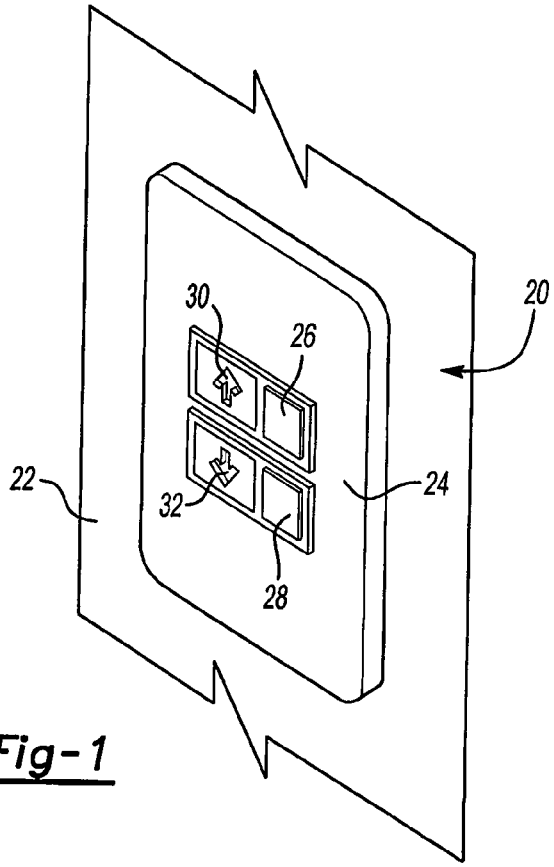
FIG. 1 diagrammatically illustrates selected portions of an elevator call button assembly designed according to an embodiment of this invention.

An example call button assembly 20 is shown in FIG. 1. The call button assembly 20 is supported on a surface 22, such as a wall within a building adjacent a landing where an individual may gain access to an elevator car. A support plate 24 is secured to the wall structure 22 in a conventional manner. Call buttons 26 and 28 are manually manipulatable to indicate a desire to have an elevator car arrive at the landing and then travel is a selected direction. In this example, the call button 26 is used to call for an elevator car that will travel upward. An indicator 30 is provided adjacent the call button 26 so that an individual knows which button to push depending on the desired direction of travel. In one example, the indicator 30 lights up upon successfully manipulating the call button 26 to place the desired call. Similarly, an indicator 32 is associated with the call button 28.

Figure 2:
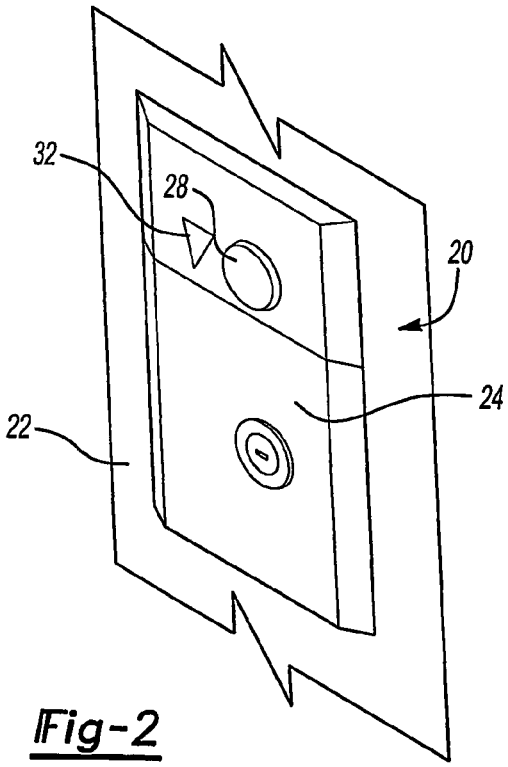
FIG. 2 diagrammatically illustrates selected portions of an alternative embodiment.

FIG. 2 shows another call button assembly 20' which is particularly useful at an uppermost or lowermost landing within a building, for example. In this example, the call button 28 and indicator 32 are provided to indicate that the only possible direction of travel from the example landing is down.

Figure 3:
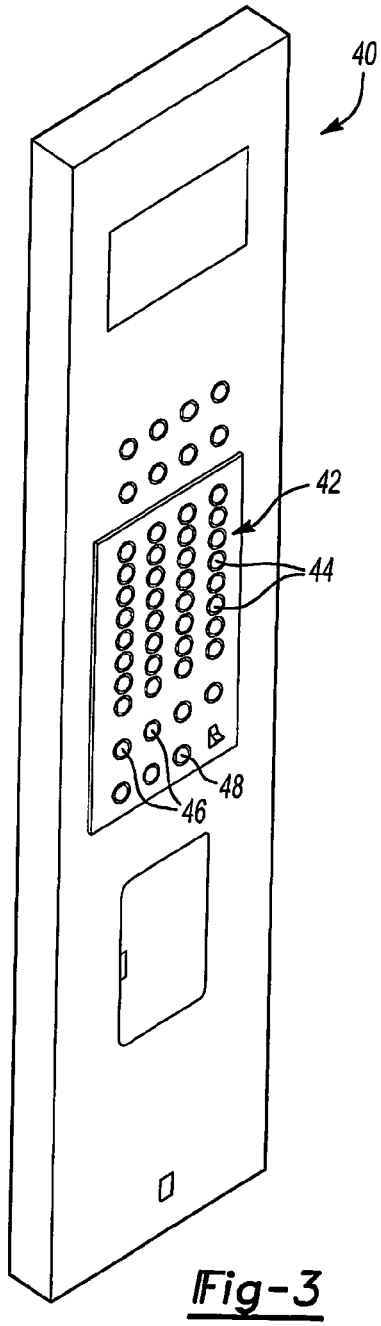
FIG. 3 diagrammatically illustrates selected portions of a call button arrangement designed according to this invention that is useful in a car operating panel.

Another call button assembly 40 is shown in FIG. 3. This example comprises a car operating panel having a passenger interface 42. A plurality of call buttons 44 allow an individual to indicate what floor to which they desire the elevator car to travel. A plurality of door control switches 46 are also useable to send a signal indicating a desired door operation (i.e., hold the door open). An emergency call button 48 allows a passenger within the car to call for assistance in the event of some elevator system trouble, for example.

A variety of call button structures are useable within the scope of this invention. One example arrangement includes a depressible button that requires some movement of a button surface to activate a switch that corresponds to sending a signal indicating the individual's intention such as having the elevator car travel to a specific floor level. In another example, the call button is capacitive and only requires physical contact with an individual's skin to send the call signal. In another example, the call button is part of a touch screen.

Figure 4:
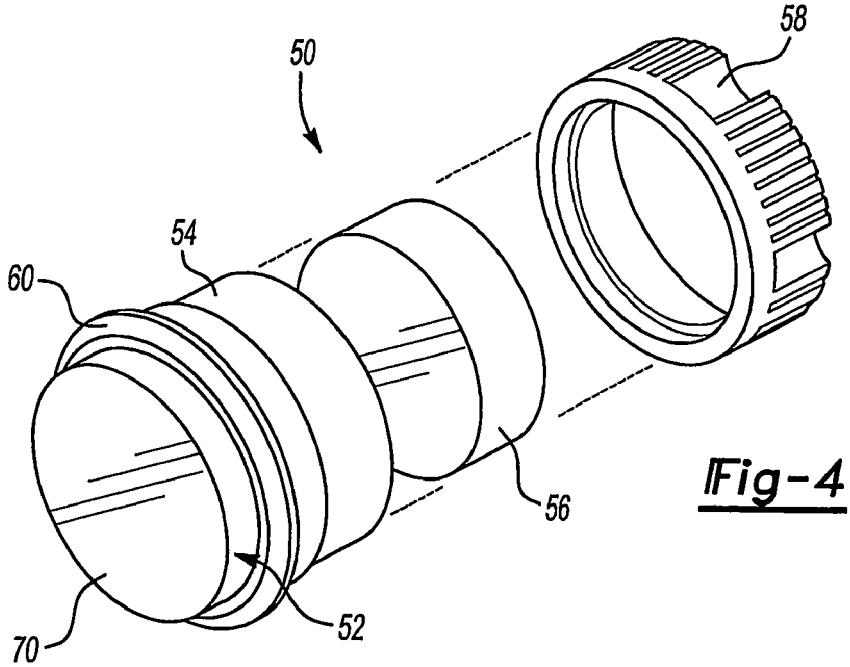
FIG. 4 is a perspective, exploded view schematically illustrating one example embodiment of a call button designed according to this invention.
Figure 5:
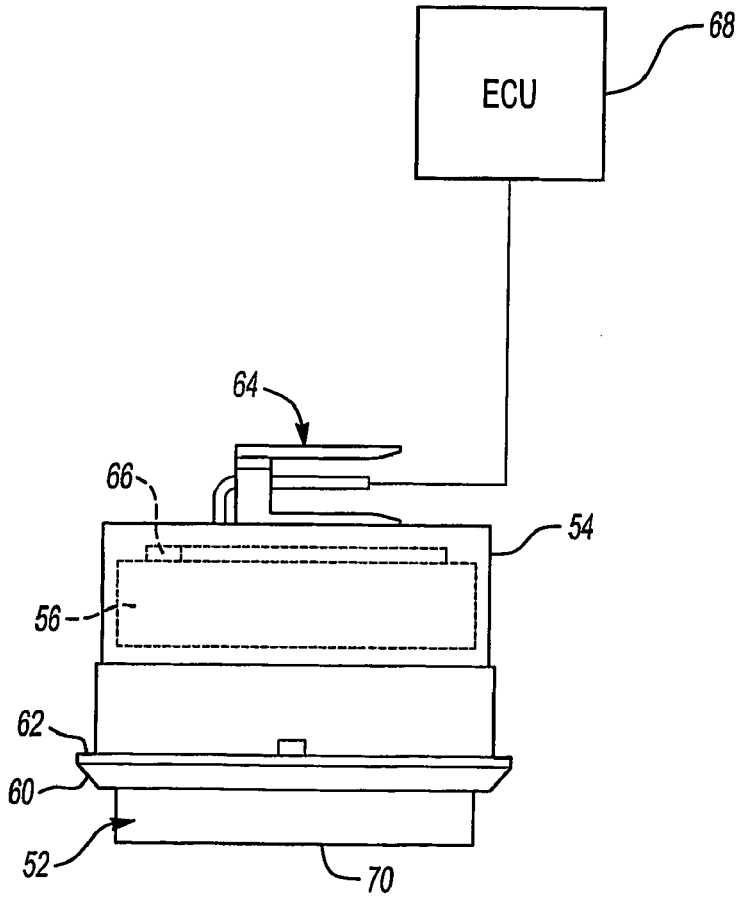
FIG. 5 is a side, elevational view of the embodiment of FIG. 4.

FIGS. 4 and 5 schematically show one example call button assembly 50. A moveable member 52 is supported for movement relative to a housing 54. A responder 56, which is an automated mover in this example, is supported within the housing 54. The automated mover in one example comprises a vibrating motor such as a pancake or coin type vibrating motor available from JinLong Machinery of New York. Those skilled in the art who have the benefit of this description will be able to select an appropriate device that will provide a tactile indication that is able to be sensed by an individual activating the call button.

A retaining ring 58 secures the housing 54 behind the mounting plate 24 in a conventional manner. A finishing ring 60 cooperates with the retaining ring 58 and has a surface 62 that is received against the wall plate 24 to provide a finished look, for example.

As shown in FIG. 5, an electrical connector 64 facilitates making a connection between an electrical terminal 66 on the automated mover 56 and the elevator system controller 68. When an individual makes appropriate contact with a surface 70 of the moveable member 52, a signal is sent to the controller 68 indicating the desired call. In this example, once the controller 68 receives the call and determines that it can appropriately respond, the controller 68 sends a signal to the automated mover 56, which then causes movement of the moveable member 52 in a manner that is tactilely recognizable by the individual contacting the surface 70.

In another example, the automated mover 56 provides the tactile indication once the surface 70 is manipulated. In this example, no signal from the controller 68 is required to actuate the automated mover.

In one example, the automated mover 56 comprises a vibrating motor that vibrates the moveable member 52 relative to the housing 54. The vibrating motion of the moveable member 52 provides tactile feedback to the individual that the desired call has been placed and will be processed in due course. In one example, the moveable member 52 reciprocates along an axis relative to the housing 54 because of the motion of the vibrating motor 56. In another example, the moveable member 52 vibrates in more than one direction (i.e., back-and-forth and side-to-side) responsive to activation of the vibrating motor 56.

The preceding description is exemplary rather than limiting in nature. Variations and modifications to the disclosed examples may become apparent to those skilled in the art that do not necessarily depart from the essence of this invention. For example, another type of tactile indication other than a vibratory motion may be used. The scope of legal protection given to this invention can only be determined by studying the following claims.

We claim:

1. A device for placing a call in an elevator system, comprising:

a surface that is manually touchable to indicate a desired call;

a controller that determines whether the elevator system can respond to the desired call; and a responder that automatically provides a tactile confirmation of the desired call responsive to a signal from the controller once the controller determines that the elevator system can respond to the desired call.

2. The device of claim 1, wherein the surface is supported on a moveable member that is manually moveable to indicate the desired call.

3. The device of claim 2, wherein the responder comprises an automated mover that automatically moves the moveable member to provide the tactile confirmation.

4. The device of claim 3, comprising a housing that supports the moveable member such that the moveable member is manually moveable relative to the housing in at least one direction.

5. The device of claim 4, wherein the automated mover moves the moveable member relative to the housing.

6. The device of claim 4, wherein the automated mover moves the moveable member in a second direction relative to the housing.

7. The device of claim 3, wherein the automated mover comprises a vibrating motor.

8. The device of claim 3, wherein the automated mover moves responsive to a manual manipulation of the moveable member.

9. The device of claim 3, including a controller that determines when the moveable member has been moved and the automated mover moves responsive to the controller.

10. The device of claim 1, wherein the surface is capacitive and the device provides a call signal responsive to human contact with the surface.

11. The device of claim 1, wherein the surface is supported on a hall call button that is adapted to be placed on a selected surface in a building.

12. The device of claim 11, wherein the surface is supported on a moveable member that is manually moveable to indicate the desired call.

13. The device of claim 12, wherein the responder comprises an automated mover that automatically moves the moveable member to provide the tactile confirmation.

14. The device of claim 13, wherein the automated mover comprises a vibrating motor.

15. The device of claim 1, wherein the surface is supported on a car operating panel that is adapted to be placed in an elevator car.

16. The device of claim 15, wherein the surface is supported on a moveable member that is manually moveable to indicate the desired call.

17. The device of claim 16, wherein the responder comprises an automated mover that automatically moves the moveable member to provide the tactile confirmation.

18. The device of claim 17, wherein the automated mover comprises a vibrating motor.

19. A method of acknowledging that a call button signal has been received in an elevator system, comprising:

determining a desired call responsive to a call button signal;

determining whether the elevator system can respond to the desired call; and providing a tactile confirmation at the call button to indicate that the elevator system can respond to the desired call.

20. The method of claim 19, including automatically moving a surface that is touched by an individual.

21. The method of claim 19, including vibrating at least a portion of the call button.

* * * * *